United States Patent [19]

Dworacek

[11] Patent Number: 4,754,978

[45] Date of Patent: Jul. 5, 1988

[54] GOLF CLUB

[76] Inventor: Herbert Dworacek, Zuricherstrasse 30, CH-8700 Kusnacht, Switzerland

[21] Appl. No.: 898,150

[22] Filed: Aug. 20, 1986

[30] Foreign Application Priority Data

Aug. 20, 1985 [AT] Austria ..... 2421/85

[51] Int. Cl.[4] ..... A63B 69/36; A63B 53/00

[52] U.S. Cl. ..... 273/193 R; 273/35 R; 273/77 R; 273/81.3; 273/194 R

[58] Field of Search ..... 273/81 A, 81.3, 81 C, 273/81 D, 81.2, 77 R, 87 C, 35 R, 188 R, 193 R, 194 R

[56] References Cited

U.S. PATENT DOCUMENTS

| | | | |
|---|---|---|---|
| 792,631 | 6/1905 | Taylor | 273/81 R |
| 1,616,377 | 2/1927 | Kight | 273/81.3 |
| 1,919,221 | 7/1933 | Janes | 273/81.3 |
| 1,920,169 | 8/1933 | Briggs | 273/81.3 X |
| 2,273,416 | 2/1942 | Norwood | 273/81 D |
| 2,938,728 | 5/1960 | Green | 273/81.3 |
| 3,462,155 | 8/1969 | Pelz | 273/81.3 X |
| 3,533,630 | 10/1970 | LoMonaco | 273/81.3 X |
| 3,663,019 | 5/1972 | Palotsee | 273/81.2 |
| 4,215,860 | 8/1980 | Nakamatsu | 273/81.3 X |
| 4,252,317 | 2/1981 | Vezina | 273/81.3 X |

FOREIGN PATENT DOCUMENTS

| | | | |
|---|---|---|---|
| 437905 | 11/1935 | United Kingdom | 273/81.3 |

*Primary Examiner*—Randolph A. Reese
*Assistant Examiner*—John A. Ricci
*Attorney, Agent, or Firm*—Thomas R. Vigil

[57] ABSTRACT

The golf club is designed especially for training purposes and comprises a main shaft which is provided at one end thereof with a handle and at the other end thereof with a club head having a striking face. An auxiliary handle is provided beneath the handle of the main shaft. The auxiliary handle is rigidly connected to the main shaft by an auxiliary shaft extending from the main shaft at an approximately central position along the length of the main shaft. The handle of the main shaft and the auxiliary handle lie in a plane which is substantially parallel to the plane of the striking face of the club head. The auxiliary handle and the main handle form an acute angle of preferably from 5° to 15° therebetween.

2 Claims, 1 Drawing Sheet

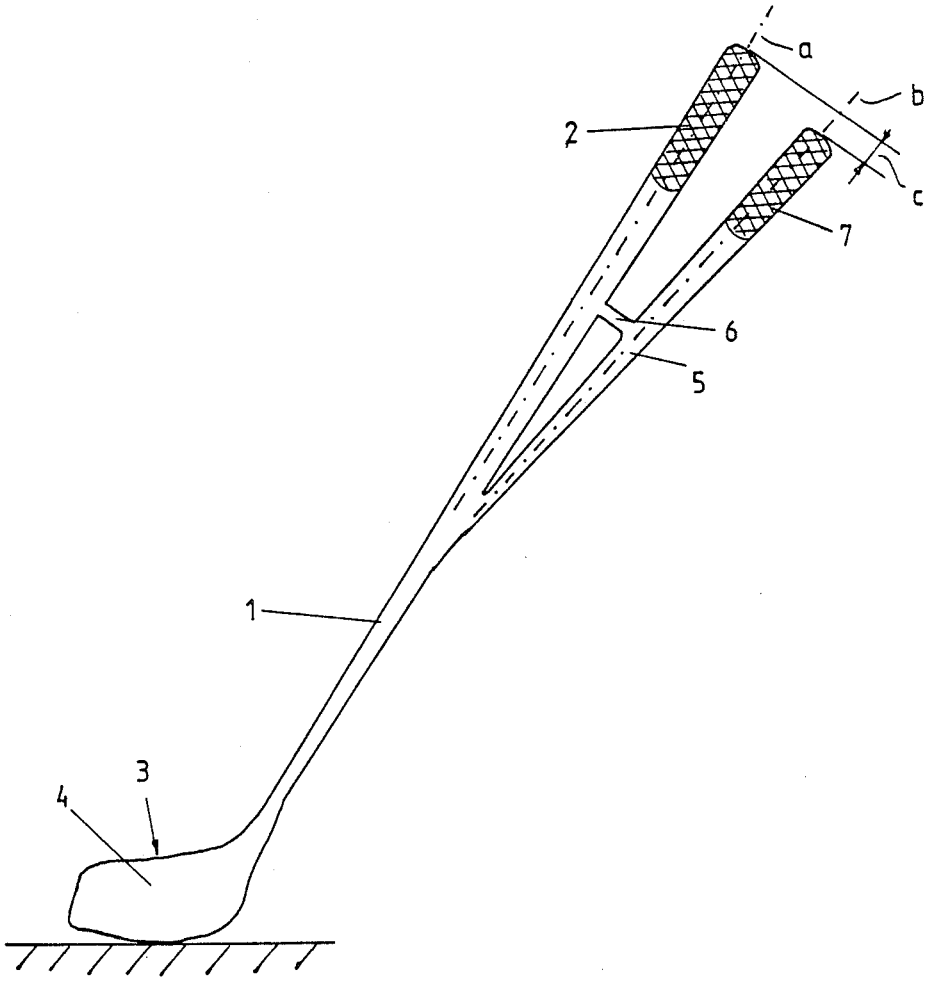
a
b
c
2
7
6
5
1
3
4

GOLF CLUB

BACKGROUND OF THE INVENTION

1. Field of the Invention

The invention relates to a golf club, especially for training purposes, comprising a shaft which is provided at its one end with a handle and at its other end with a head having a striking face.

2. Descrition of the Prior Art A conventional golf club has a straight shaft comprising at its ends the handle on the one end and the club head on the other end. When playing, the right-handed player strikes the club to the left to hit the ball—which is at rest—with the striking face to drive it into the hole. In doing so, both hands rest on the handle of the club, the right hand below the left hand in the case of right handers. Predominantly the left hand should guide the club in the swinging motion, but often—in particular with beginners and for reasons which will be illustrated in detail below—the right side guides the club so that the swinging motion becomes inharmonious.

The undesired influence of the right hand-arm side lies in particular in the fact that in its movement to the left this side performs movements directed towards the body which are superior to the movements of the left hand-arm side away from the body as required for the golf stroke (motion to the left away from the body). For movements towards the body (truncopetal, right hand to the left) are the inborn, instinctively stronger movements of the upper extremities than movements away from the body (truncofugal, left hand to the left). Compare the difficulties with the backhand stroke in tennis, which may be regarded partly as a defense reaction against the approaching ball.

SUMMARY OF THE INVENTION

It is an objection of the invention to provide a golf club which preferably is to be used merely for training purposes and offers in particular the beginner the opportunity of gradually diminishing the dominance of the hand-arm unity, i.e. of eliminating or reducing the undesired influence on the striking motion. In this connection it is pointed out that all considerations made here apply accordingly to left-handed players and golf clubs built accordingly, here the motion is just the opposite and the influence of the left hand is undesired.

The object of the invention may be achieved with a golf club of the type mentioned above, which according to the invention is provided with an auxiliary handle below the handle—seen in the striking position of the club—said auxiliary handle being rigidly connected with the shaft, the plane formed by the axes of the handle and the auxiliary handle being disposed substantially parallel to the plane of the striking face of the club head.

Thanks to the invention the player's one hand—with the right-handed player the left hand—may clasp the (main) handle of the club, while the other hand rests on the auxiliary handle, whereby the auxiliary handle also guides the other (right) hand, but the inborn intentional dominance of motion of the right hand is reduced. This is partly due to the fact that the right arm no longer lies in the axis of the shaft.

The usual grip unity of both hands is broken up by the separate handles and the player may consciously use both arms differently, thus achieving the desired dominance of motion of the left hand and of the left arm, respectively.

When striking, the right arm stays below the left arm and the right elbow may be kept more easily at the right hip when the downward swing occurs. The tendency, particularly widespread among beginners, to flex the wrists during the downswing at the moment of impact may greatly be reduced. The player's attention may be focussed rather on the movement of the arms, away from the club, so that more attention may be paid to both arms which may be guided more consciously.

In the upswing motion the left unity arm-hand moves the club above the head until the left shoulder is in contact with the chin; as a result of the separate handles the right unity arm-hand remains rather passive at a right angle at the elbow so that also in the downswing motion it necessarily moves past the right hip because of the auxiliary handle and leaves the entire power for the follow-through to the left club side.

In practice one embodiment of the invention, in which the auxiliary handle is arranged at the end of an auxiliary shaft, and the axis of the auxiliary shaft and auxiliary handle forms an acute angle of preferably from 5° to 15° with the axis of the shaft, has proved especially useful.

In this embodiment it is of advantage when the auxiliary shaft ends in the shaft at approximately half the length of the club.

The club may be handled more comfortably if—seen in the direction of the handle axes—the auxiliary handle ends at a distance before the end of the handle.

The invention and its additional advantages and features are described in greater detail below with the help of examples which are illustrated in the drawing.

BRIEF DESCRIPTION OF THE DRAWING

The FIGURE is a side view of a first embodiment of a golf club according to the invention.

DESCRIPTION OF THE PREFERRED EMBODIMENT

According to the FIGURE, the golf club according to the invention comprises a straight shaft 1 which in a known manner is provided with a handle 2 at one end and with a club head 3 at the other (lower) end. In general the shaft 1 is tapered downwardly and the handle 2 may be covered with e.g. leather, plastic or cork. The club head 3 may have any of the known diverse shapes and comprises a striking face 4 coacting with the golf ball. An auxiliary shaft 5 ends in the shaft 1 at approximately half the length of the club. This auxiliary shaft 5 is disposed—seen in the illustrated striking position of the club—below the shaft 1, the axis b of the auxiliary shaft 5 and the axis a of the shaft 1 forming an acute angle of preferably from 5° to 15°. To stiffen the club the auxiliary shaft 5 may be connected with the shaft 1 e.g. by a crossbar 6. An auxiliary handle 7, which may likewise be formed by covering or coating the end of the shaft with a nonslip material, is arranged at the end of the auxiliary shaft 5. Seen in the direction of the axis a and b, respectively, the auxiliary handle 7 may end at a distance c before the end of the handle 2, resulting in a good adaptation to the anatomical conditions.

The shaft 1, the club head 3 and the handles 2, 7 may be made of the known materials used for golf clubs, such as steel, wood, plastic, etc.

The auxiliary shaft 5 need not, as shown in the FIGURE, be disposed below the handle 2, rather the positions of the handle and the auxiliary handle may be exchanged as compared with the position shown in the FIGURE.

I claim:

1. A golf club, especially for training purposes, comprising a main straight shaft which is provided at one end thereof with a handle and at another end thereof with a head having a striking face, characterized in that an auxiliary handle is provided beneath the handle of the main shaft, said auxiliary handle being rigidly connected to the main shaft by means of an auxiliary shaft on which said auxiliary handle is mounted, said auxiliary shaft extending from the main shaft, the handle of the main shaft and the auxiliary handle being disposed in a plane substantially perpendicular to the plane in which the club is swung, and with the auxiliary handle and the main handle forming an acute angle of preferably from 5° to 15° therebetween.

2. The golf club according to claim 1, characterized in that the auxiliary shaft extends from the main shaft at a position which is approximately at the center of the main shaft.

* * * * *